US007121653B2

(12) United States Patent
Lai

(10) Patent No.: US 7,121,653 B2
(45) Date of Patent: Oct. 17, 2006

(54) NEGATIVE-PRESSURE CONTROL DEVICE FOR INK-SUPPLY SYSTEM

(75) Inventor: Jin-Sheng Lai, Hsi Chih (TW)

(73) Assignee: Greater Computer Corporation, Hsi Chih (TW)

( * ) Notice: Subject to any disclaimer, the term of this patent is extended or adjusted under 35 U.S.C. 154(b) by 272 days.

(21) Appl. No.: 10/885,793

(22) Filed: Jul. 8, 2004

(65) Prior Publication Data

US 2006/0007277 A1 Jan. 12, 2006

(51) Int. Cl.
*B41J 2/175* (2006.01)

(52) U.S. Cl. ..... 347/85

(58) Field of Classification Search ..... 347/85, 347/86, 84; 141/2, 18
See application file for complete search history.

(56) References Cited

U.S. PATENT DOCUMENTS 4,412,232 A * 10/1983 Weber et al. ..... 347/68
4,435,719 A * 3/1984 Snaper ..... 347/82
5,818,485 A * 10/1998 Rezanka ..... 347/89
6,145,967 A * 11/2000 Langford et al. ..... 347/85
6,290,343 B1 * 9/2001 Lewis et al. ..... 347/85
6,478,415 B1 * 11/2002 Barinaga et al. ..... 347/85

* cited by examiner

*Primary Examiner*—Anh T. N. Vo
(74) *Attorney, Agent, or Firm*—Lowe Hauptman & Berner, LLP

(57) ABSTRACT

A negative-pressure control device for an ink-supply system comprises a box, an ink-jet head, an adapter and a set of releasable check valve mutually communicated. The box has thereon a water outlet, and is provided therein with a liquid level gauge to control and maintain a constant level of the ink in the box; by operation of a releasable check valve set, air in the ink-jet head and the adapter presents the state of negative-pressure, this maintains a balance state preventing the ink from dropping when the ink in the ink-jet head and the water outlet is subjected to attraction of the air with the negative-pressure; when the ink-jet head jet prints downwards, it can automatically supplement ink to get an effect of continuous jet printing; the control device is suitable for a jet-drawing machine to place an advertising board with a propaganda paint or a poster etc. for printing.

8 Claims, 7 Drawing Sheets

NEGATIVE-PRESSURE CONTROL DEVICE FOR INK-SUPPLY SYSTEM

BACKGROUND OF THE INVENTION

1. Field of the Invention

The present invention is related to a negative-pressure control device for an ink-supply system, and especially to a structure provided with a negative-pressure ink-jet pipeline to prevent leakage of ink in an ink-jet head, and when the ink-jet head do jet printing downwards, it makes a predetermined amount of ink in the ink-supply structure flow into the ink-jet head for continuous jet printing; the present invention is suitable for a jet-drawing machine to place an advertising board with a propaganda paint or a poster etc. for printing.

2. Description of the Prior Art

In markets, to get the goal of marketing of various commodities, people engaging in packaging and planning normally present the effect of advertisement with outdoor measures including a large stage background, an exhibition by illuminating or a car body advertising, and with indoor measures including small decorative paints, commodity display promotion and showcase display etc., in order that they can attract consumers' eye sights to achieve the object of sale.

As to the above stated various advertisements, people in the art normally use a jet-drawing machine to jet print on a soft thing such as a cloth or a paper. A jet printing structure "a" of the jet-drawing machine can be horizontally displaced on the machine, as shown in FIG. 7. It mainly comprises an ink box "b" and a micro-piezoelectric jet head "c", these two are connected by means of a hose "d" fully filled with ink. When the jet head "c" has not yet be operated, the air pressure in the ink box "b" and the pressure of the atmosphere are in a balance state, hence the ink will not be jetted; when the jet head "c" jet prints outwards, the ink box "b" supplements ink for the jet head "c" to get the effect of jet printing.

Although the above stated jet printing structure "a" of the jet-drawing machine can get the effect of continuous jet printing on a soft material. By the fact that the soft material of a cloth or a paper is mounted on the jet-drawing machine in an inclined mode, the height of the ink box "b" is lower than that of the horizontal height of the jet head "c", the entire jet printing structure "a" forms an angle. And in practical application, the cloth or the paper can be bent at will to be coincident with the angle required for jet printing. This will not make any inconvenience for the soft material. However, for a hard plane board unable to be curved, a situation results: a small plane board often drops during jet printing, while a large plane board is unable to be placed on the machine for jet printing. Therefore, it is a problem hard to deal by a conventional jet-drawing machine with such hard plane boards.

SUMMARY OF THE INVENTION

In view of the above defects to be solved, in order not only to provide a negative-pressure control device for an ink-supply system from ink leakage, but also to synchronically supplement ink wanted for continuously jet printing an advertising board placed on a plane, the inventor provides the present invention based on his professional experience of years in studying and improvement.

The primary object of the present invention is to provide a negative-pressure control device for an ink-supply system specific for printing a plane board, an ink-jet pipeline provided in the control device can have partial air drawn by an air drawing structure to form a negative-pressure state, so that a constant negative pressure can be maintained to attract the ink in an ink-jet head to prevent the ink from leaking downwards.

The secondary object of the present invention is to provide a negative-pressure control device for an ink-supply system, a box provided in the control device has ink therein maintained a constant atmospheric pressure, an ink-jet outlet of the ink-jet head is faced downwards; when in jet printing of the ink-jet head, ink in the box can be moved out through a water outlet and flows into the ink-jet head to synchronically supplement ink wanted for the ink-jet head, so that the problem of inability of jet printing a hard advertising board placed on a plane by a conventional jet-drawing machine can be solved.

Another object of the present invention is to provide a negative-pressure control device for an ink-supply system, the control device can synchronically activate a liquid pump to immediately supplement the ink by controlling of a liquid level gauge when the amount of ink in the box is insufficient, thereby an effect of quantitatively supplying ink can be obtained.

Therefore, in order to achieve the objects of the present invention, a kind of negative-pressure control device for an ink-supply system of the present invention comprises a box, an ink-jet head, an adapter and a set of releasable check valve. The box has thereon a hole, and is connected with a water inlet and a water outlet; the box is provided therein with a liquid level gauge to control and maintain a constant level of the ink in the box; the ink-jet head has on its top an ink inlet and an ink spilling port both communicating with the inner receiving space of the ink-jet head, the ink-jet head has on its bottom an ink-jet outlet to jet print downwards; the adapter is provided with a connecting hole, a siphon pipeline and a reflux pipeline, the siphon pipeline is connected between the box and the ink-jet head, and the reflux pipeline makes communication of the siphon pipeline with the ink spilling port; the releasable check valve set has an end connected with the connecting hole of the adapter, and has the other end connected with an air drawing pipeline to draw the air of the ink-jet head and the adapter to make states of negative-pressure.

Thereby, the ink in the ink-jet head and the water outlet is subjected to attraction of the air with the negative-pressure, to maintain a balance state preventing from dripping; when the ink-jet head jet prints downwards, it can automatically supplement ink to get an effect of continuous jet printing, the amount of ink in the box thus can be supplemented by controlling of the liquid level gauge.

The present invention will be apparent after reading the detailed description of the preferred embodiment thereof in reference to the accompanying drawings.

DETAILED DESCRIPTION OF THE PREFERRED EMBODIMENT

Figure 1:
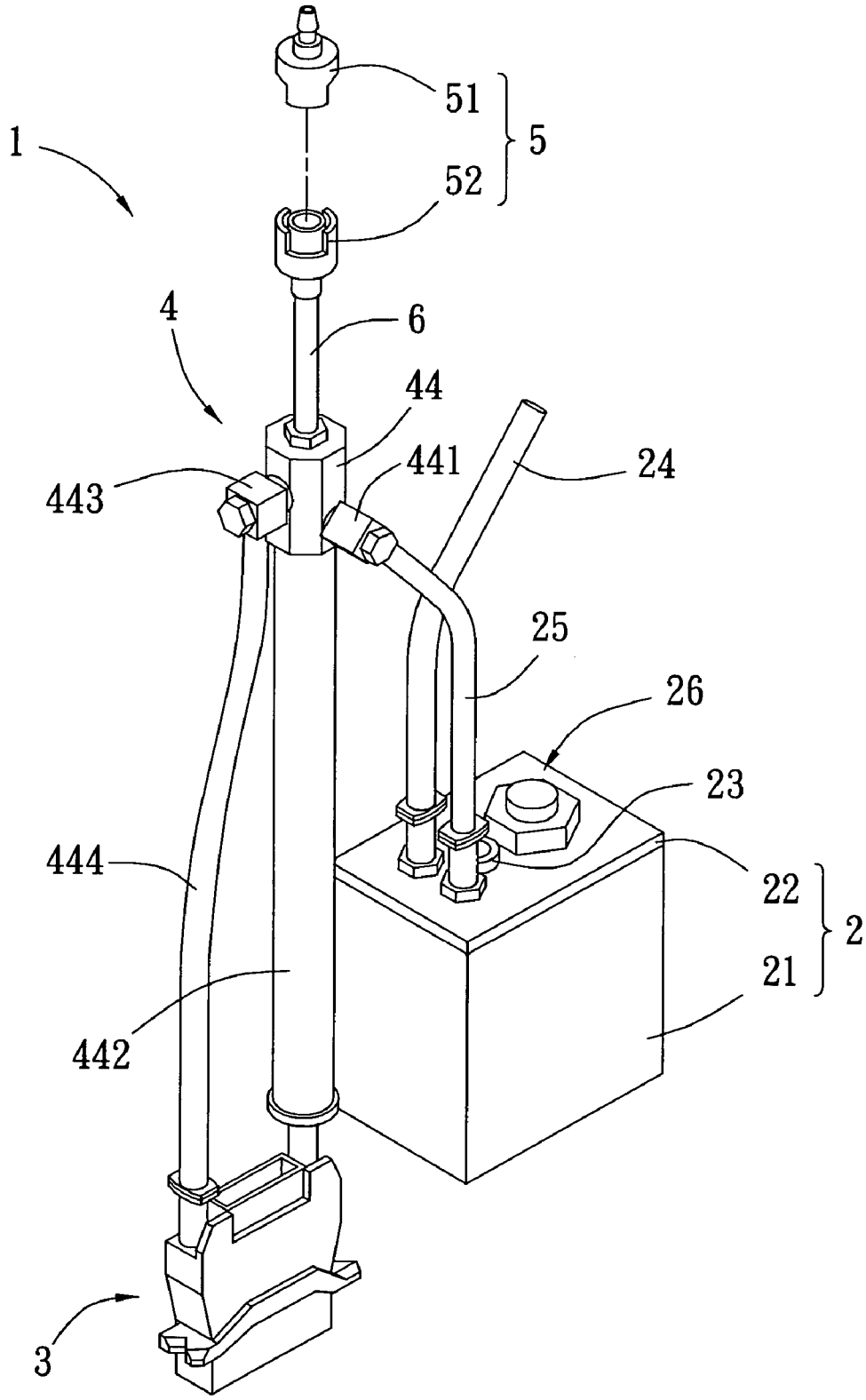
FIG. 1 is a perspective view showing the appearance of a negative-pressure control device for an ink-supply system of the present invention.
Figure 2:
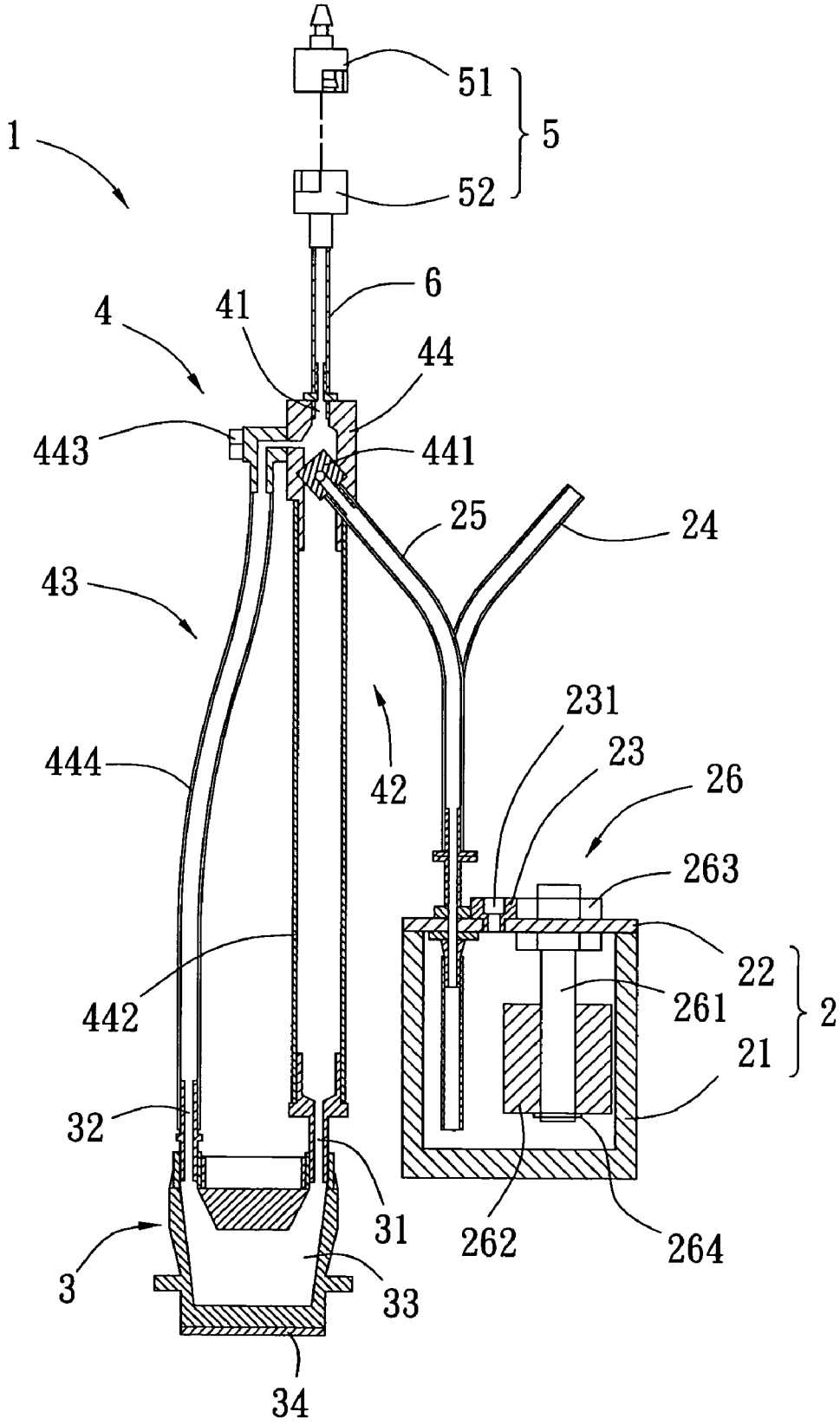
FIG. 2 is a sectional view showing assembling of the negative-pressure control device for an ink-supply system of the present invention.

Referring firstly to FIGS. 1, 2 showing a preferred embodiment of a negative-pressure control device 1 for an ink-supply system of the present invention, the control device 1 comprises a box 2, an ink-jet head 3, an adapter 4 and a set of releasable check valve 5.

The box 2 is a rectangular member, and includes a base 21 having an upper opening and an upper cover 22 covering the base 21; the upper cover 22 is provided with an air filter 23 having a hole 231 from the top to the bottom of the box 2 for filtering air, and for maintaining an atmospheric pressure for the interior and the exterior of the box 2; the box 2 is connected on the top thereof with a water inlet 24 and a water outlet 25; the box 2 is provided therein with a liquid level gauge 26, the liquid level gauge 26 includes a straight rod 261, a buoy 262 and a connecting member 263; the connecting member 263 is divided into an upper and a lower part to tightly clamp the upper cover 22, the straight rod 261 is connected on its upper end with the connecting member 263 and is provided on its lower end with a stop piece 264; the buoy 262 is slipped over the straight rod 261, and can move up and down relatively to the straight rod 261.

The ink-jet head 3 is a micro-piezoelectric jet head, and has on its top an ink inlet 31 and an ink spilling port 32 both communicating with an inner receiving space 33 of the ink-jet head 3, the ink-jet head 3 has on its bottom an ink-jet outlet 34.

The adapter 4 is provided with a connecting hole 41, a siphon pipeline 42 and a reflux pipeline 43, the siphon pipeline 42 is connected between the box 2 and the ink inlet 31 of the ink-jet head 3, and is composed of the water outlet 25 on the box 2, a first connecting member 441 on an adapter head 44 and a first hose 442; the reflux pipeline 43 makes communication of the siphon pipeline 42 with the ink spilling port 32 of the ink-jet head 3; and is composed of a second connecting member 443 and a second hose 444 connected to each other. The siphon pipeline 42 and the reflux pipeline 43 are arranged in parallel connection.

The releasable check valve set 5 has a male connector 51 and a female connector 52, the bottom end of the female connector 52 is connected with the connecting hole 41 of the adapter head 44 by means of a hose 6, the male connector 51 can be connected to an air drawing pipeline (not shown).

Figure 3:
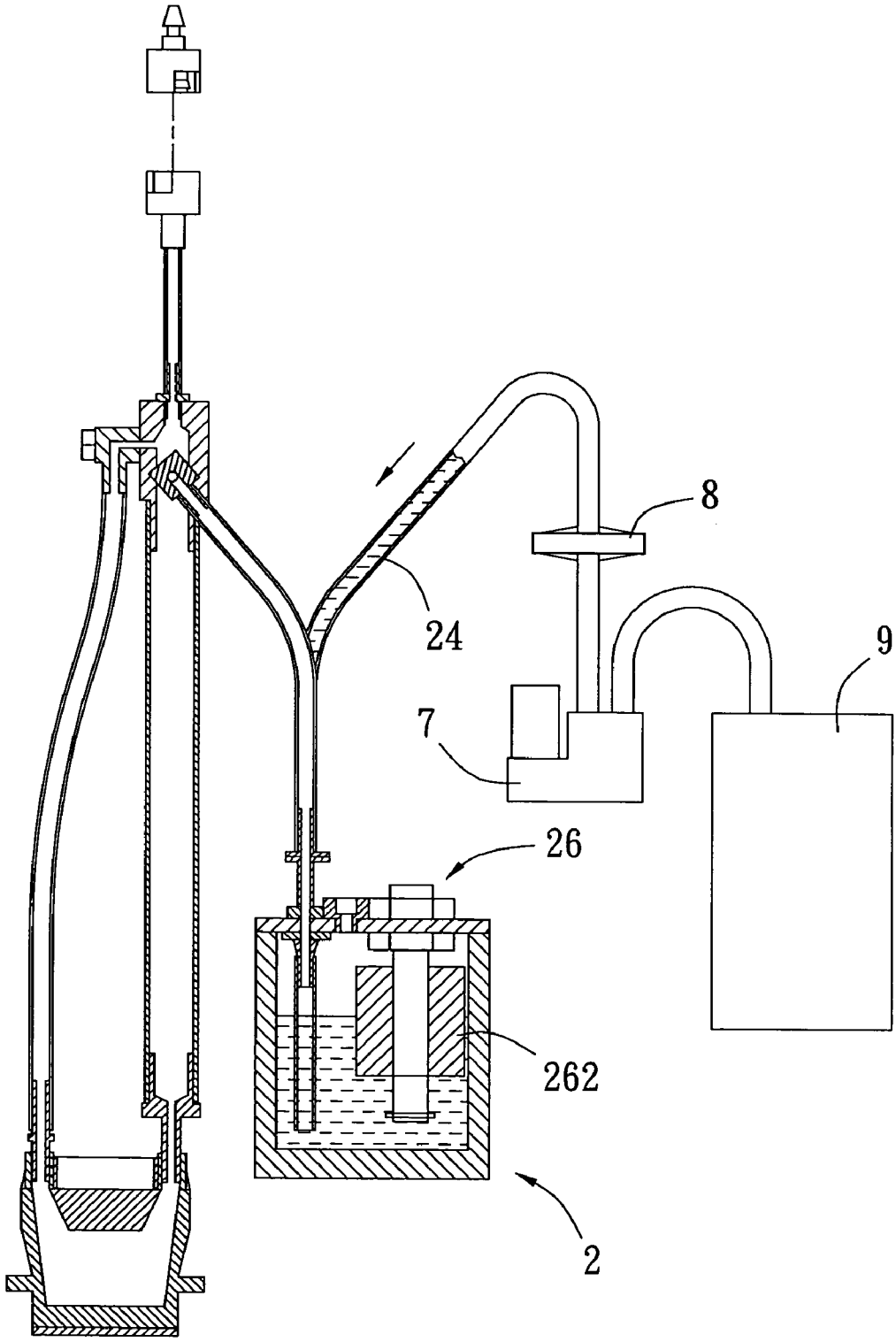
FIG. 3 is a schematic view showing the state of ink supplying before initiating of use of the present invention.

Referring to FIG. 3 showing the state of ink supplying before initiating of use of the present invention, the ink in a filtering vessel 9 is drawn out by means of a liquid pump 7 and an ink filter 8, and is injected into the box 2 via the water inlet 24 on the top of the box 2. When the ink reaches a predetermined level, the buoy 262 of the liquid level gauge 26 can be raised to control the liquid pump 7 to stop operation, and to control the ink in the box 2 to maintain at a predetermined level; further by an automatic supplementing function, the liquid pump 7 starts to operate when the buoy 262 is lowered, in order to supplement ink for the box 2.

Figure 4:
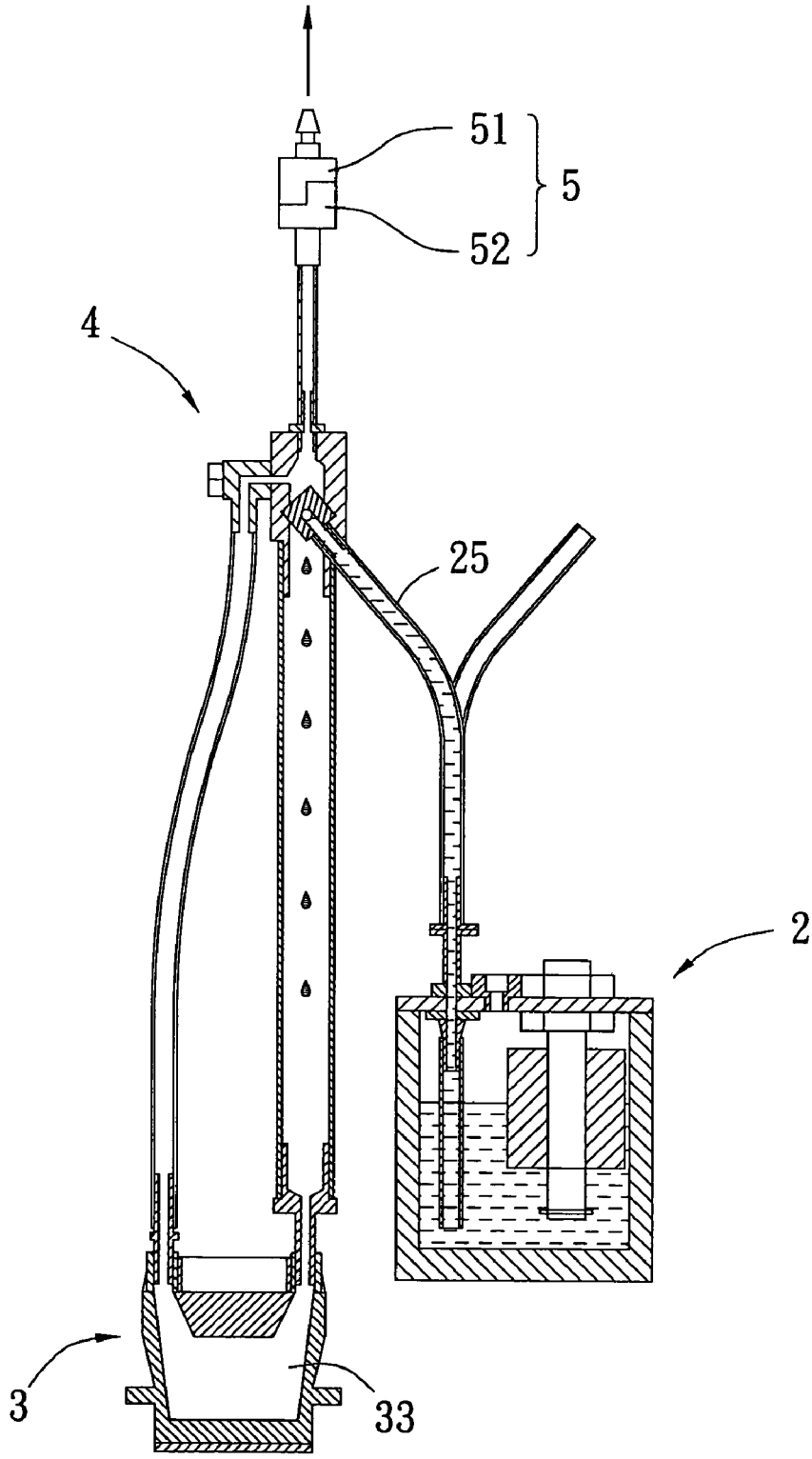
FIG. 4 is a schematic view showing the state of ink supplying during connecting of a male connector with a female connector of a check valve of the present invention.
Figure 5:
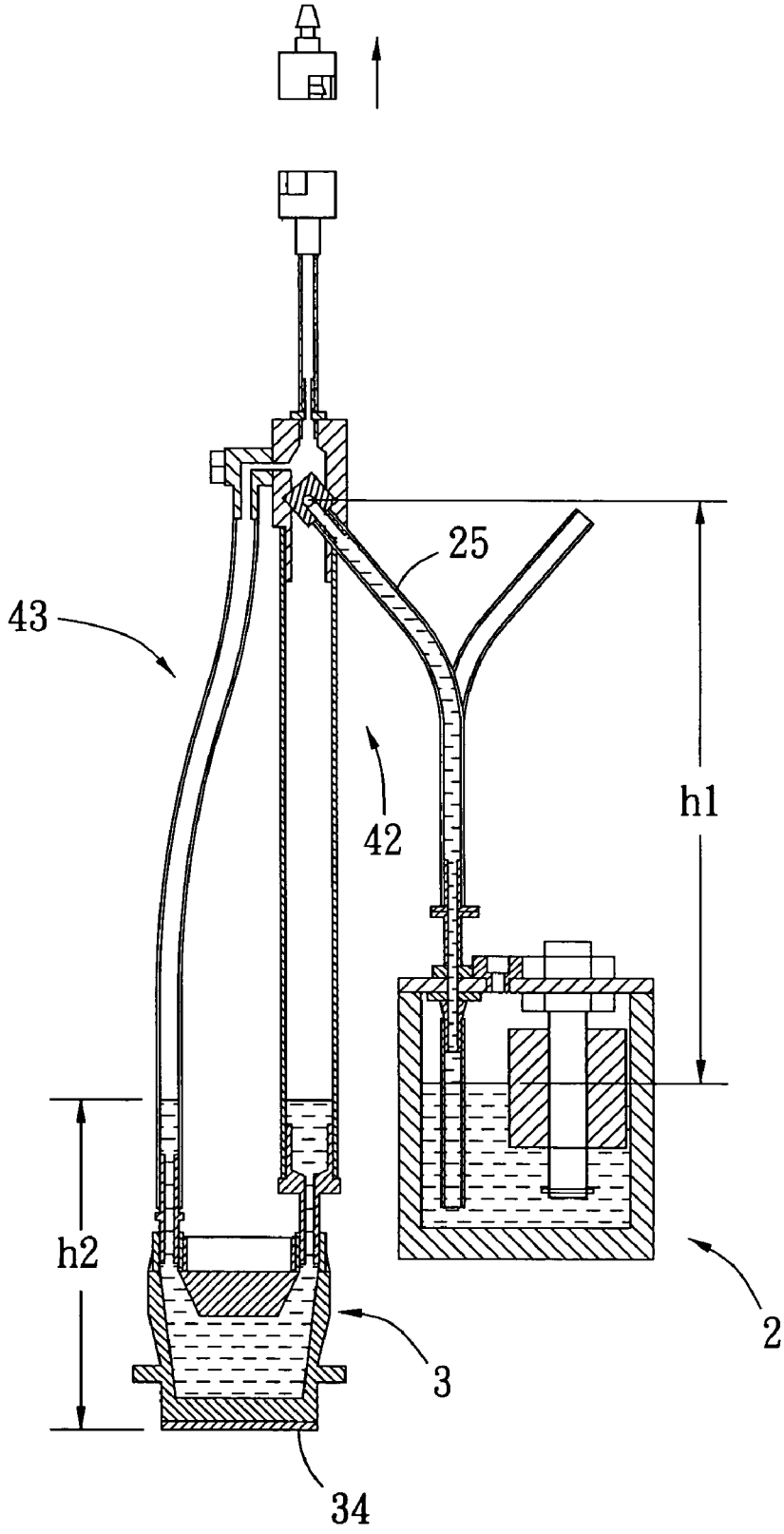
FIG. 5 is a sectional view showing the state of a constant negative pressure of an ink-jet head and an adapter of the present invention.

Referring to FIGS. 4 and 5, when, the male connector 51 and the female connector 52 both of the releasable check valve set 5 are connected with each other, the air in the ink-jet head 3 and the adapter 4 can be drawn out via the air drawing pipeline to make a state of negative pressure, now the air pressure in the box 2 is larger than that in the adapter 4; after drawing out the ink of the box 2, the ink drops into the inner receiving space 33 of the ink-jet head 3 via the water outlet 25 until a difference h1 of height of the liquid level of the water outlet 25 from that of the ink in the box 2 is higher than a difference h2 of height of the liquid ink level of the ink-jet outlet 34 of the ink-jet head 3 from that of the siphon pipeline 42 and the reflux pipeline 43; thereby ink in the water outlet 25 is subjected to attraction of the negative pressure and is able to maintain a balance state preventing ink from dropping, while the ink in the ink-jet head 3 will not leak downwards by the function of the negative pressure.

Figure 6:
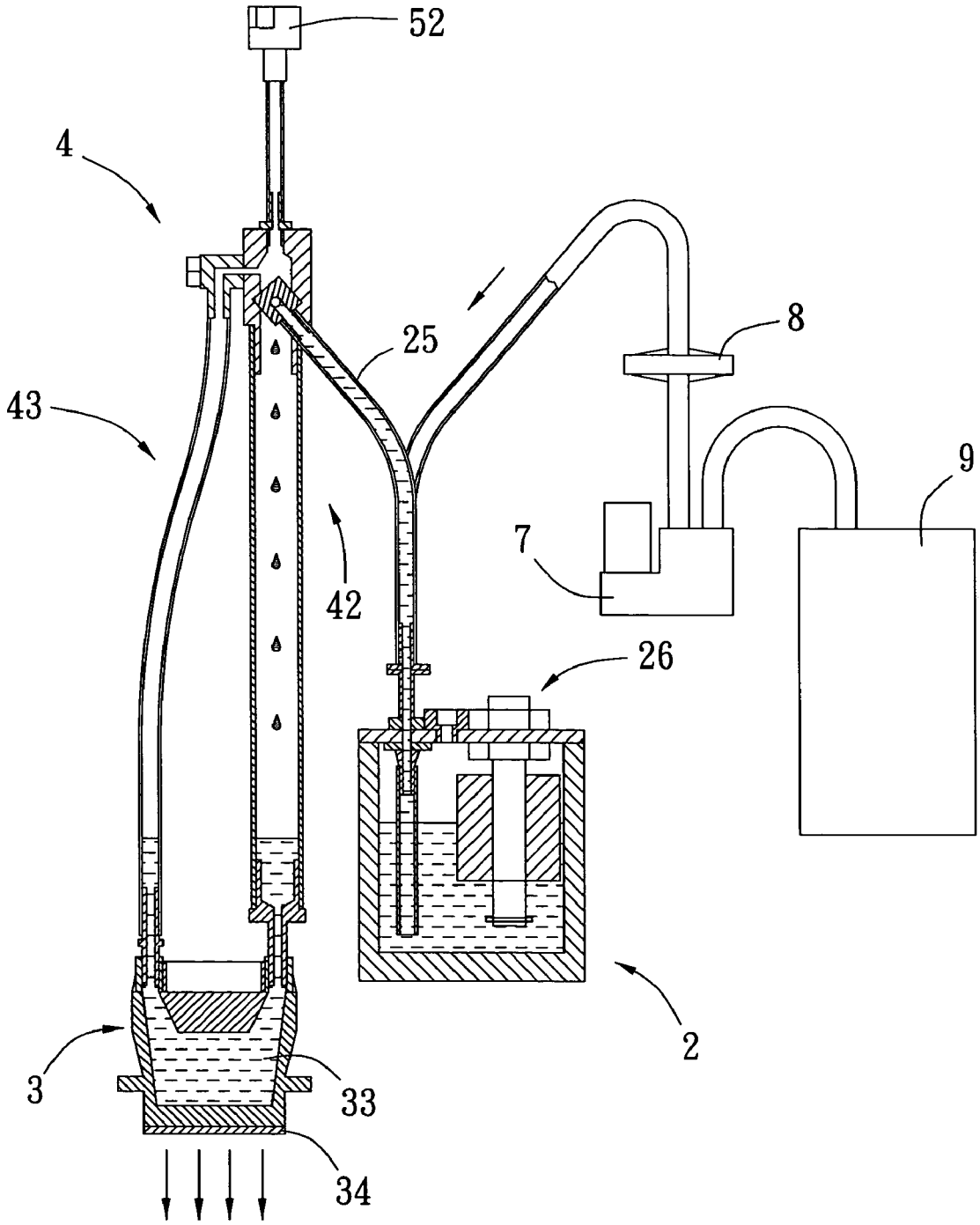
FIG. 6 is a schematic view showing the state of ink supplying during jet printing of the ink-jet head of the present invention.
Figure 7:
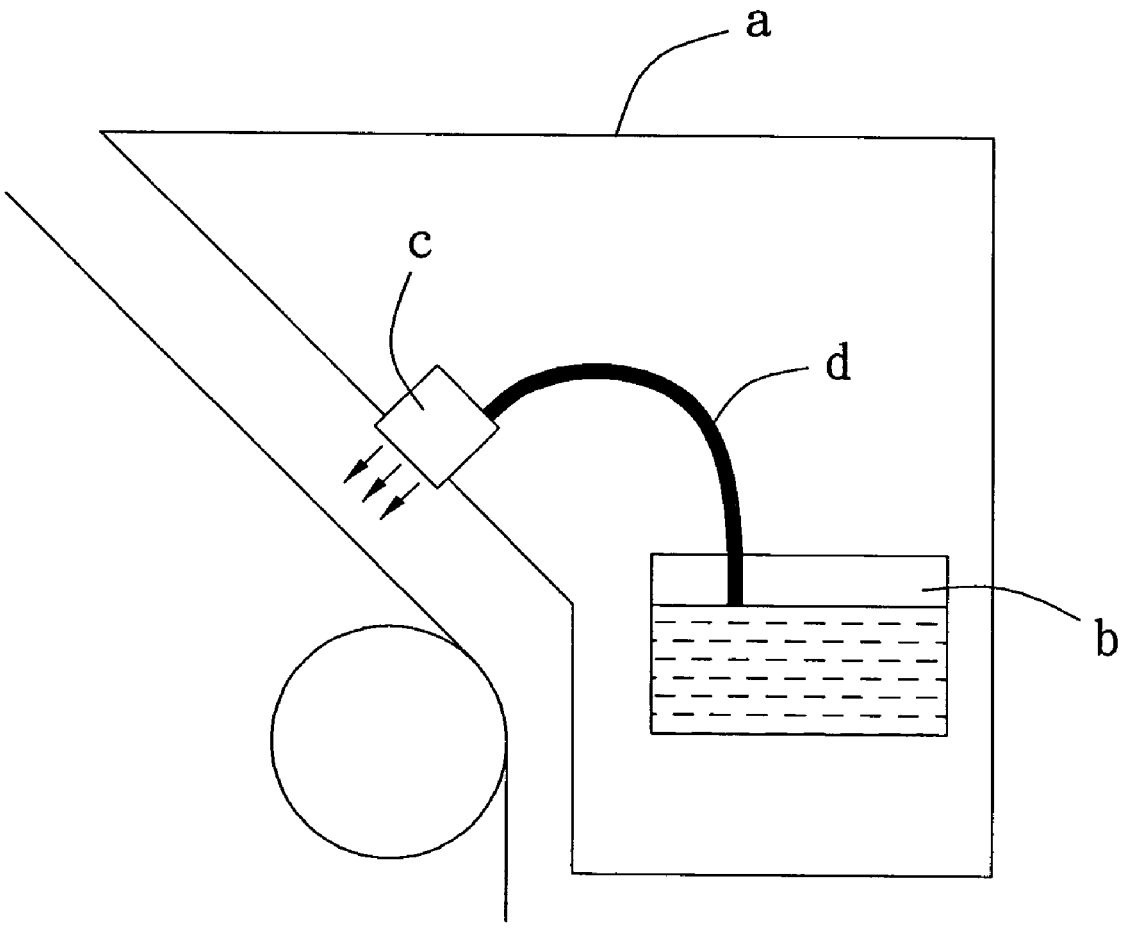
Fig. 7(Prior Art)
FIG. 7 is a schematic view showing the state of use of a jet-printing structure of a conventional jet-printing machine.

Referring to FIG. 6, when the height h1 of the liquid ink level in the box 2 is larger than the height h2 of the liquid level of the siphon pipeline 42 and the reflux pipeline 43, the interiors of the ink-jet head 3 and the adapter 4 is in the state of a constant negative pressure, at this time, the male connector 51 and the female connector 52 both of the releasable check valve set 5 are separated from each other; when the ink-jet head 3 is used to jet print downwards via the ink-jet outlet 34, the ink in the box 2 drops down from the top of the water outlet 25 into the inner receiving space 33 of the ink-jet head 3 to supplement ink for the ink-jet head 3; and by controlling of the liquid level gauge 26, the box 2 can be supplemented with ink to a predetermined content, so that the ink-jet head 3 can do continuous jet printing without a phenomenon of inadequacy of ink.

Thereby the present invention has the following advantages:

1. The siphon pipeline and the reflux pipeline of the present invention can draw in partial air via an air drawing pipeline to maintain a constant negative pressure, when the ink-jet head is not in use, the ink in the ink-jet head can be effectively controlled not to leak downwards.

2. In use of the present invention, by virtue that the ink in the box is maintained at a constant atmosphere pressure, when the ink-jet head jet prints downwards, ink can be automatically supplemented to get an effect of continuous jet printing, the ink in the ink-jet head can be supplemented immediately during using; and by virtue that the ink-jet outlet 34 of the ink-jet head faces downwards, a hard advertising board placed in a plane can be continuously jet printed without hindering, this is an effect that a conventional jet-drawing machine is unable to reach.

3. The liquid level gauge provided in the present invention has a buoy designed to be automatically raised and lowered in pursuance of the amount of ink, when the ink in the box is inadequate, it synchronically activates a liquid pump to immediately supplement the ink; and when the ink-jet head is used continuously, an effect of supplying with constant amount of ink can be acquired.

In conclusion, according to the description disclosed above, the present invention surely can get the expected object thereof to provide a negative-pressure control device for an ink-supply system, the control device not only prevents ink in an ink-jet head from ink leakage, but also synchronically supplements ink wanted for continuously jet printing an advertising board placed on a plane during jet printing of the ink-jet head.

I claim:

1. A negative-pressure control device for an ink-supply system, said control device comprises:

a box having thereon a hole, and connected with a water inlet and a water outlet, said box is provided therein with a liquid level gauge to control and maintain a constant level of ink in said box;

an ink-jet head having on its top an ink inlet and an ink spilling port both communicating with an inner receiving space of said ink-jet head, said ink-jet head has on its bottom an ink-jet outlet to jet print downwards;

an adapter provided with a connecting hole, a siphon pipeline and a reflux pipeline, said siphon pipeline is connected between said box and said ink-jet head, and said reflux pipeline makes communication of said siphon pipeline with said ink spilling port; and a set of releasable check valve having an end connected with said connecting hole of said adapter, and having another end connected with an air drawing pipeline to draw air in said ink-jet head and said adapter to make states of negative-pressure;

thereby, said ink in said ink-jet head and said water outlet is subjected to attraction of air with said negative-pressure, to maintain a balance state preventing said ink from dropping; when said ink-jet head jets prints downwards, said ink-jet head is automatically supplements ink to get an effect of continuous jet printing, the amount of said ink in said box thus is synchronically supplemented by controlling of said liquid level gauge.

2. The negative-pressure control device for an ink-supply system as in claim 1, wherein: said siphon pipeline and said reflux pipeline are arranged in parallel connection.

3. The negative-pressure control device for an ink-supply system as in claim 1, wherein: said adapter includes an adapter head, said siphon pipeline is composed of said water outlet on said box, a first connecting member on said adapter head and a first hose; said reflux pipeline is composed of a second connecting member and a second hose connected to each other.

4. The negative-pressure control device for an ink-supply system as in claim 1, wherein: said releasable check valve set has a bottom end connected with said connecting hole of said adapter head by means of a hose.

5. The negative-pressure control device for an ink-supply system as in claim 1, wherein: said box is provided with an air filter having a hole from the top to the bottom of said box for filtering air, and for maintaining an atmosphere pressure for the interior and the exterior of said box.

6. The negative-pressure control device for an ink-supply system as in claim 1, wherein: said box includes a base having an upper opening and an upper cover covering said base.

7. The negative-pressure control device for an ink-supply system as in claim 1, wherein: said liquid level gauge includes a connecting member, a straight rod and a buoy; said buoy moves up and down relatively to said straight rod, an upper end of said straight rod extends upwardly through said upper cover and is connected with said upper cover by means of said connecting member.

8. The negative-pressure control device for an ink-supply system as in claim 1, wherein: said control device includes an ink filter and a liquid pump, said liquid pump is activated to immediately supplement ink in said box when said buoy is lowered.

* * * * *